US005477664A

United States Patent [19]

Carroll

[11] Patent Number: 5,477,664

[45] Date of Patent: Dec. 26, 1995

[54] COMPACT BALLOON INFLATER AND LOADER APPARATUS AND METHOD

[75] Inventor: William G. Carroll, Salt Lake City, Utah

[73] Assignee: Maxim, Inc., Salt Lake City, Utah

[21] Appl. No.: 289,140

[22] Filed: Aug. 11, 1994

Related U.S. Application Data

[63] Continuation of Ser. No. 732,155, Jul. 18, 1991, Pat. No. 5,337,540.

[51] Int. Cl.[6] ..... B65B 43/36; B65B 39/02

[52] U.S. Cl. ..... 53/570; 53/262; 53/385.1; 53/386.1; 53/390

[58] Field of Search ..... 53/403, 432, 441, 53/453, 459, 469, 479, 481, 79, 468, 86, 103, 512, 556, 559, 570, 385.1, 386.1, 390, 416, 433, 511, 255, 262; 141/10, 51, 59

[56] References Cited

U.S. PATENT DOCUMENTS

| | | | |
|---|---|---|---|
| 1,598,089 | 8/1926 | Langkopf | 53/103 X |
| 2,604,244 | 7/1952 | Tripp | 53/386.1 |
| 3,798,870 | 3/1974 | Kanner et al. | 53/386.1 X |
| 4,924,919 | 5/1990 | Oyler | 53/386.1 X |
| 4,974,393 | 12/1990 | Rich et al. | 53/79 X |
| 5,033,256 | 7/1991 | Rupp | 53/385.1 |
| 5,337,540 | 8/1994 | Carroll | 53/459 |

*Primary Examiner*—Horace M. Culver
*Attorney, Agent, or Firm*—Thorpe North & Western

[57] ABSTRACT

Apparatus for inflating balloons to enable insertion thereinto of objects includes a loading ring insertable into the orifice or mouth of the balloon for stretching the orifice to allow insertion therethrough of an object into the interior of the balloon when inflated, and a balloon inflating housing for accommodating an inflated balloon. The housing includes upper and lower hemispherical shells which may be sealingly fitted together to form a complete spherical shell and to allow inflation of the balloon therewithin, and then separated to allow removal of the inflated balloon. The housing further includes an annular opening located in the upper hemispherical shell through which a balloon orifice may extend, a support ring disposed in the annular opening for receiving the loading ring so that a balloon in whose orifice the loading ring is inserted extends downwardly into the housing, and an opening in the lower hemispherical shell through which air may be evacuated from the housing to cause inflation of the balloon. The lower hemispherical shell may be coupled to a pump so that when the pump is operated, air from the interior of the housing is removed to thereby inflate a balloon disposed within the housing.

1 Claim, 3 Drawing Sheets

COMPACT BALLOON INFLATER AND LOADER APPARATUS AND METHOD

This application is a continuation of application Ser. No. 07/732,155 filed Jul. 18, 1991 U.S. Pat. No. 5,337,540.

BACKGROUND OF THE INVENTION

1. Field

This invention relates to an apparatus and method for stretching the orifice of a balloon, inflating the balloon and inserting an object or objects into the inflated balloon.

2. Prior Art

A recently popularized packaging arrangement for gifts involves stretching the orifice or mouth of a balloon, inflating the balloon, inserting the gift into the inflated balloon, and then tying off the orifice to prevent the escape of air and to maintain the balloon, with the gift inside, in the inflated condition. The inflated balloon with gift can then be presented to the recipient.

A number of approaches and apparatus have been developed for inflating the balloon to allow insertion thereinto of the gift or other objects including what has been termed positive-pressure system such as disclosed in U.S. Pat. Nos. 4,809,483, 4,809,484, 4,811,841 and 4,878,335. In these systems, the balloon is inflated by forcing air under positive-pressure into the balloon to allow the ultimate insertion thereinto of the desired object. With these systems, typically some type of apparatus is necessary for moving the object from the positive-pressure source into the inflated balloon and so it is difficult to reorient or reposition the object in the balloon if such is necessary.

A more recent approach to inflating balloons to allow the insertion of objects thereinto involves the use of so-called negative-pressure systems such as disclosed, for example, in U.S. Pat. Nos. 4,924,919 and 4,974,393. In these systems, a balloon is positioned in a housing with the balloon orifice in communication with the outside. The housing is then evacuated of air to cause the balloon to expand. After expansion, and with the balloon orifice still exposed to the outside, the desired object can be inserted through the orifice into the interior of the balloon. With these systems, it is oftentimes easier to reorient or reposition the object inside the balloon to place it in precisely the position desired.

Another negative-pressure system presently available to the public includes upper and lower hemispherical shells which may be fitted together to form a complete spherical shell. The upper hemispherical shell includes an opening and a mounting ring fitted in the opening upon which a balloon orifice may be stretched and mounted so that the balloon depends into the spherical shell. The spherical shell is placable on an evacuation pump which, when operated, pumps air from the interior of the hemispherical shell out through openings in the lower hemispherical shell to cause the balloon to expand and allow insertion through the orifice of an object. The balloon orifice may then be tied off, the two hemispherical shells separated, and the balloon removed.

The above-described hemispherical shell arrangement, although quite compact and efficient in inflating a balloon to allow insertion of objects thereinto, has a number of drawbacks. Among these is the difficulty in mounting a balloon orifice on the ring fixed in the upper hemispherical shell. Such mounting requires the folding of the balloon orifice laterally and downwardly about an upstanding ridge and then pushing the balloon body through the opening and into the interior of the hemispherical shell. Another drawback is the difficulty of maintaining the balloon in the inflated condition when the air pump is turned off to allow insertion of an object into the balloon. That is, the seal between the exterior of the balloon and the interior of the spherical shell is generally not reliable to prevent air from entering that space to cause deflation of the balloon. Still another drawback is the lack of an effective seal between the spherical shell and the pump motor housing which requires that the pump work larder to evacuate the spherical shell and maintain the balloon in the inflated condition.

SUMMARY OF THE INVENTION

It is an object of the invention to provide a new and improved apparatus and method for efficiently and easily inflating a balloon to allow insertion thereinto of gifts and other objects.

It is also an object of the invention to provide such apparatus and method which may be easily manipulated and handled to install the balloon in position for inflation.

It is a further object of the invention to provide such apparatus and method in which a balloon may be maintained in the inflated position without continued operation of the evacuating pump by reason of provision of an effective seal between the exterior of the balloon and the interior of the inflating chamber.

It is still another object of the invention to provide such apparatus and method in which there is very little leakage of air at the interface between the inflating chamber and the evacuating pump.

It is an additional object of the invention to provide such apparatus and method in which a balloon to be inflated may be easily installed on a loading ring which is separate and apart from the rest of the housing.

The above and other objects of the invention are realized in a specific illustrative embodiment of apparatus for inflating balloons, such apparatus including a loading ring insertable in the orifice of a balloon for maintaining the orifice in an expanded condition to allow insertion therethrough of an object into the interior of the balloon when inflated, and a balloon inflating housing for accommodating an inflated balloon and onto which the loading ring may be fitted. The housing includes upper and lower hemispherical shells which may be sealingly fitted together to allow inflation of the balloon therewithin, and then separated to allow removal of the inflated balloon. The housing also includes an annular opening located in the upper hemispherical shell through which a balloon orifice may extend, a support ring disposed in the annular opening for receiving and holding the loading ring so that a balloon in whose orifice the loading ring is inserted extends downwardly into the housing, and an opening in the lower hemispherical shell through which air may be evacuated from the housing to cause inflation of the balloon. An evacuation pump is also provided to allow coupling to the lower hemispherical shell so that when the pump is operated, air is evacuated from the interior of the housing to thereby inflate a balloon disposed in the housing.

In accordance with one aspect of the invention, the support ring includes a downwardly extending lip positioned such that when a balloon is inflated, whose orifice is expanded about a loading ring, the support ring is expanded, the exterior of the balloon inflates to a sealingly contact to the lip to prevent the passage of air therebetween.

In accordance with another aspect of the invention, the support ring also includes an annular upstanding ridge within which the loading ring may be fitted and held in place.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 2:
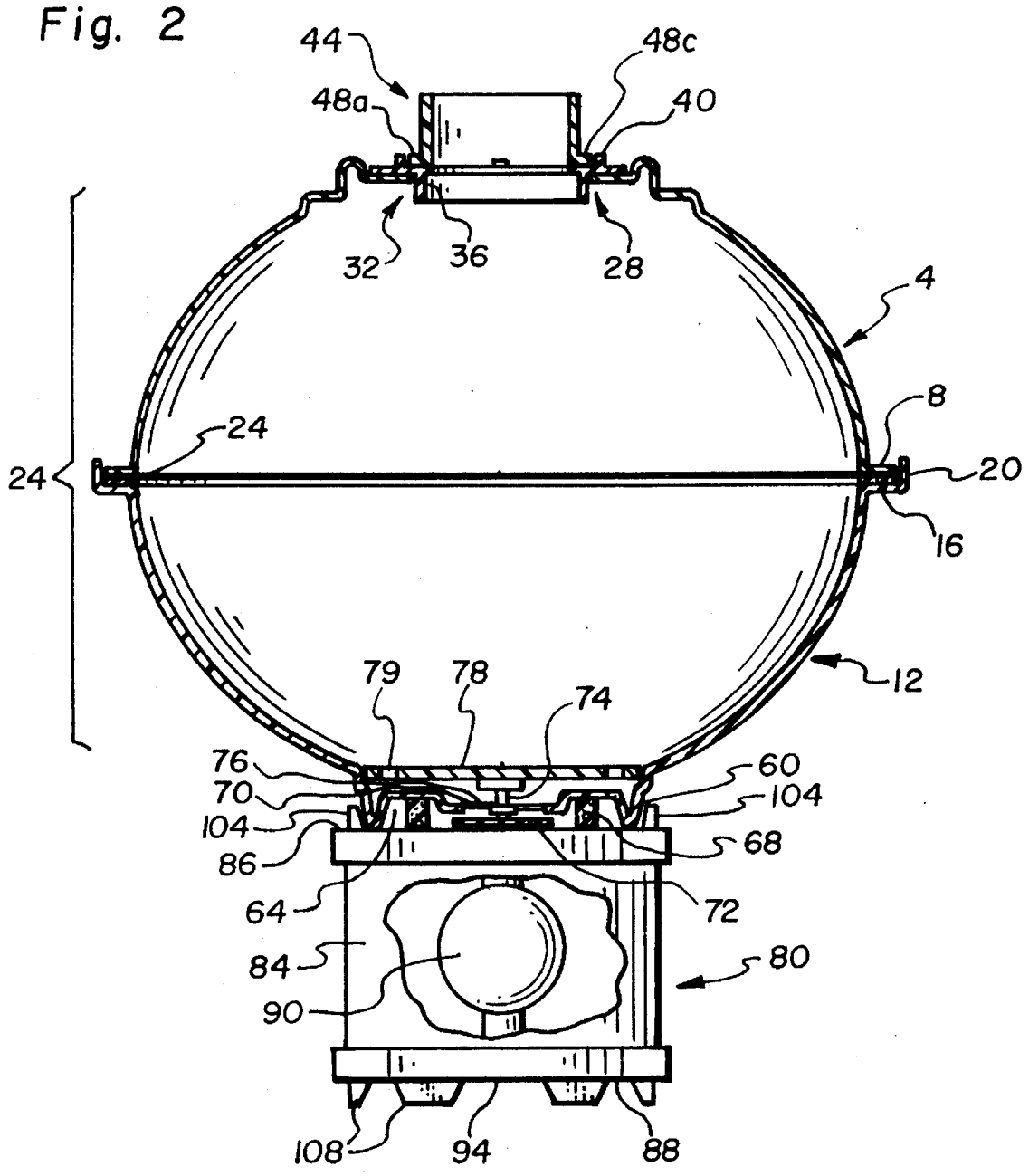
FIG. 2 is a side, elevational, partially cross-sectional view of the apparatus of FIG. 1.

Referring to the drawings, there is shown one illustrative embodiment of balloon inflating apparatus made in accordance with the present invention, which also may be used to practice the method of the present invention. The apparatus includes an upper hemispherical shell 4 made, for example, of clear plexiglass or plastic, and including an outwardly extending circumferential lip 8. Also included is a lower hemispherical shell 12 also advantageously made of clear plexiglass or plastic. Extending radially outwardly from the lower section 12 at the point of greatest diameter is a circumferential lip 16 having an upstanding ridge 20 for receiving and supporting the upper hemispherical shell 4 as best indicated in FIG. 2. A resilient seal 24, best seen in FIG. 2, is disposed on the lip 16 on the entire circumference of the lip to support and seal with the lip 8 of the upper hemispherical shell 4. The upstanding ridge 20 circumscribes the lip 8 to prevent lateral or sideways movement of the upper hemispherical shell 4 to in effect maintain the shell in place on the lower hemispherical shell 12. The upper hemispherical shell 4 and lower hemispherical shell 12 together form a complete a spherical shell 24, again as best seen in FIG. 2.

The top of the upper hemispherical section 4 is formed with an opening 28 into which is fitted an annular support ring 32. The support ring 32, which might illustratively be made of a rigid plastic, includes a downwardly extending annular lip 36 (best seen in FIG. 3) and an upwardly projecting annular ridge 40. The function of the lip 36 and ridge 40 will be discussed momentarily.

The support ring 32 is dimensioned to receive a loading ring 44 also made, for example, of a fairly rigid plastic. The loading ring 44 is in the form of a short hollow cylinder the lower end of which includes four laterally extending lip segments 48*a*, 48*b*, 48*c* and 48*d* (this last segment is not shown in the drawings). These lip segments are positioned co-circumferentially about the bottom of the loading ring 44, being separated by short gaps as shown.

Figure 3:
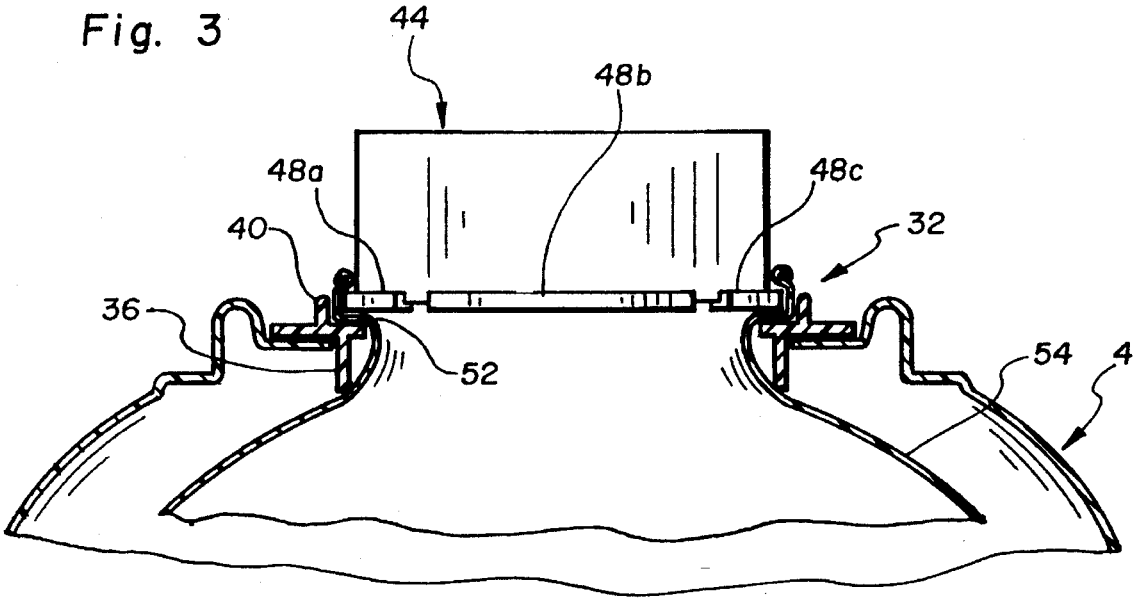
FIG. 3 is a side, partially cross-sectional, fragmented view of the upper portion of the apparatus of FIGS. 1 and 2.

The loading ring 44 is provided as a separate unit from the rest of the apparatus to allow easy insertion thereof into the orifice of a balloon. FIG. 3 shows graphically a balloon mouth 52 being stretched about the bottom of the loading ring 44 and over the lip segments 48. The lip segments, since they protrude laterally from the loading ring, serve to hold the balloon mouth or orifice onto the loading ring and prevent it from slipping off. Providing lip segments 48*a*, 48*b*, 48*c* and 48*d* makes it easier to insert the loading ring 44 into a balloon orifice since part of the orifice can be placed over a first one of the segments, then over a next adjacent segment, etc. until the orifice has been fitted over the entire lower circumference of the loading ring. When properly loaded, the loading ring 44, with balloon depending therefrom, is placed on the support ring 32 at a position within and circumscribed by the upstanding ridge 40, as best seen in FIG. 3. As will be described later, in this position the balloon is ready to be inflated within the complete spherical shell 24 (FIG. 2) to allow insertion thereinto of a gift or other object.

The lower end of the lower hemispherical shell 12 is formed with an annular downwardly projecting base 60 for supporting the lower hemispherical shell when it is placed upon pump apparatus 80. Formed just radially inwardly of the annular base 60 is an upwardly formed depression 64 (FIG. 2) in which is disposed a resilient annular seal ring 68 made, for example, of resilient closed-cell foam rubber or similar resilient material. Centrally of the lower section of the lower hemispherical shell 12 is an opening 70 through which air may be withdrawn from the complete spherical shell 24 when using the apparatus to inflate a balloon. Disposed below the opening 70 to prevent air from entering the spherical shell 24 is a flexible disk 70 which, when air attempts to enter the shell, is pushed against the lip of the opening 70 to prevent air from entering the opening, but which, when air attempts to leave the spherical shell 24, flexes away from the opening 70 to allow the air to pass thereby. The disk 72, in effect, forms a one-way valve to allow the flow of air out of the spherical shell 24 but to prevent the flow of air thereinto. The disk 72 may be made of an air impervious, flexible piece of rubber or similar material. The disk 72 is held in place by a bolt 74 which, in turn, is mounted on a brace 76 disposed in the opening 70.

Mounted on the upper end of the bolt 74 is a floor 78 formed with a plurality of openings 79 disposed circumferentially near the outer edge of the floor. The openings 79 allow air to pass from the interior of the spherical shell 24 through to the opening 70 and then out the opening to the pump 80 as will next be discussed. The floor 78 and opening 79 allow a balloon to expand thereagainst while still allowing air to flow through the openings to escape the interior of the spherical shell 24 when the spherical shell is coupled to the pump 80.

Figure 1:
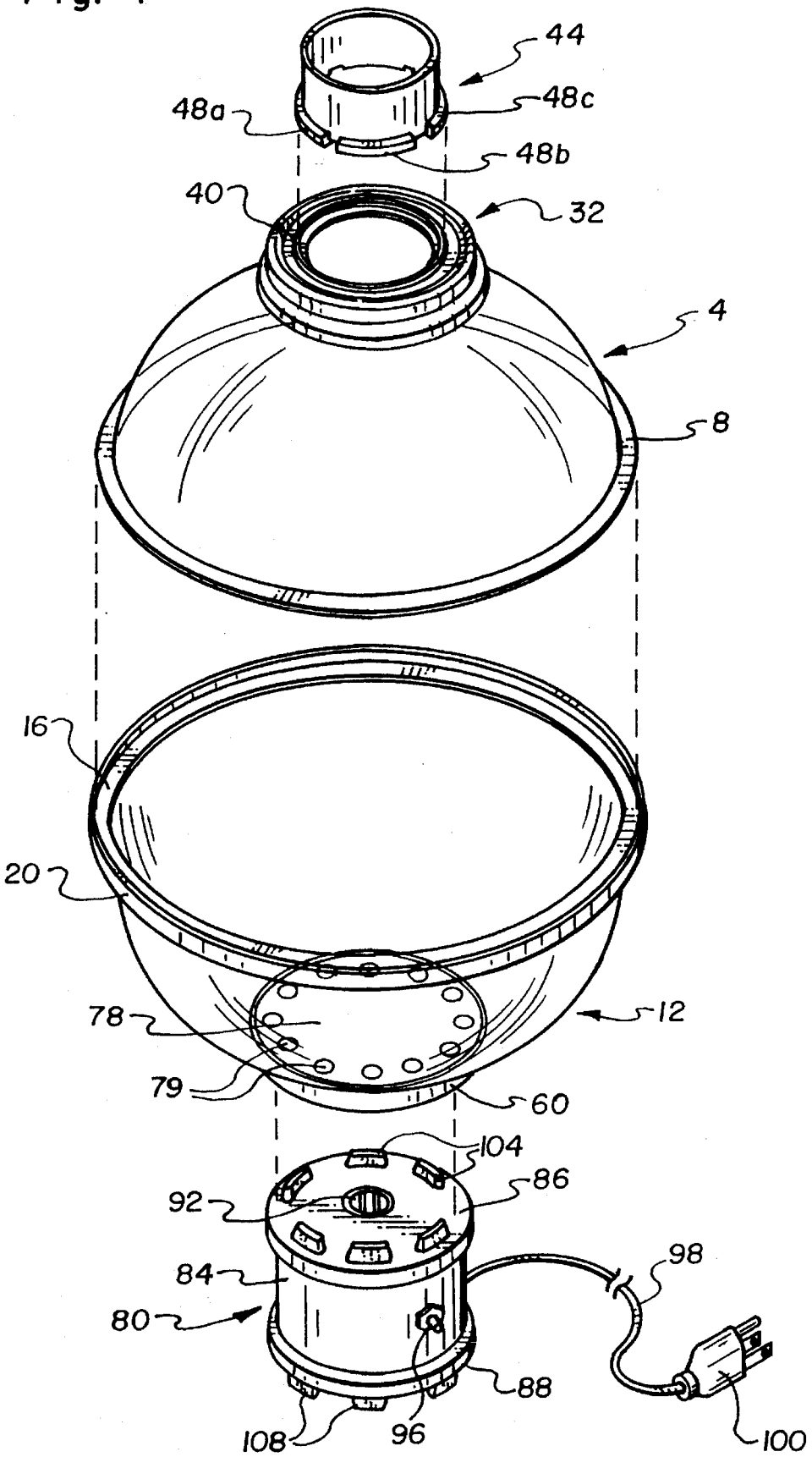
FIG. 1 is a perspective, exploded view of the balloon inflating apparatus made in accordance with the principles of the present invention.

The pump 80 includes a pump housing 84 having a top wall 86 and a bottom wall 88, and in which is located a pump motor 90 (FIG. 2) coupled to an opening 92 in the top wall 86 of the housing 84, and to an opening 94 in the bottom wall 88 of the housing. When the pump motor 90 is operated, air is drawn into the opening 92 and passed out of the opening 94 in a conventional manner. A switch 96 (FIG. 1) is provided to turn the pump motor 90 off and on, and a cord 98 and plug 100 are provided to connect the pump motor to a source of electrical power to operate the pump. Formed on the top wall 86 of the housing 84 are a plurality of co-circumferential, spaced-apart ridges 104 which circumscribe the annular base 60 when the spherical shell 24 is placed on the pump 80. The plurality of ridges 104 prevents the spherical shell 24 from moving laterally and sliding off the pump 80. Disposed on the bottom wall 88 of the housing 84 are a similar plurality of downwardly extending, co-circumferential and spaced-apart ridges or feet 108 for supporting the pump housing 84 above a surface on which it is placed and to allow air which is pumped from the top opening 92 out the bottom opening 94 to freely escape from under the housing. The upstanding ridges 104 and downwardly projecting ridges or feet 108 are positioned essentially identically to one another so that the feet 108 would likewise circumscribe the annular base 60 of the spherical shell 24 if the annular base were placed therewithin. Of course, the pump 80 may be readily turned upside down to pump and force air upwardly from the housing, as well as suck and force air into the pump when positioned in the right side up disposition. In this manner, the pump 80 may be readily used either to withdraw air from a spherical shell or, if the spherical shell were so adapted, pump air into the spherical shell depending upon whether the spherical shell were placed upon the top wall 86 or the bottom wall 88 respectively.

In use, a balloon orifice 52 of a balloon 54 (FIG. 3) is placed over the lower end of the loading ring 44 and specifically over the lip segments 48*a*, 48*b*, 48*c* and 48*d* so that the balloon extends downwardly into the interior of spherical shell 24 (FIG. 2). With the spherical shell 24 placed on the pump 80 as shown in FIG. 2 and when the pump motor 90 is turned on by operating a switch 96, air is drawn from the interior of the spherical shell through opening 79 and the opening 70 and through the opening 92 in the top wall 86 of the pump housing 84 and ultimately out of the opening 94 in the bottom wall 88 of the pump housing. As air is evacuated from the interior of the spherical shell 24, the balloon 54 is caused to expand since the only way air can enter the spherical shell is through the loading ring 44 and this causes the balloon to expand. The loading ring 44 with balloon 54 installed on the lower end thereof forms a seal with a support ring 40 to prevent air from passing between the loading ring and the support ring. As the balloon 54 expands, the outer surface of the balloon contacts the downwardly extending lip 36 of the support ring 32 to form a seal between the lip and the balloon to prevent the passage of air therepast. This aids in maintaining the balloon 54 in the expanded or inflated condition within the spherical shell 24 when the pump motor 90 is turned off. After the balloon is inflated, a gift or other object may be inserted through the loading ring 44 to the interior of the balloon as desired, and then the loading ring 44 is removed from the orifice or mouth 52 of the balloon. In this condition, the orifice may be tied off by using a tether or string to prevent the escape of air from the interior of the balloon, after which the upper hemispherical shell 4 may be removed from the lower hemispherical shell 12 and the balloon may then simply be removed from between the hemispherical shells in the inflated condition and containing the gift or other object.

It is to be understood that the above-described arrangements are only illustrative of the application of the principles of the present invention. Numerous modifications and alternative arrangements may be devised by those skilled in the art without departing from the spirit and scope of the and the appended claims are intended to cover such modifications and arrangements.

What is claimed is:

1. Apparatus for inflating balloons to enable insertion thereinto of objects, comprising a loading ring for holding the orifice of a balloon in an expanded condition to allow insertion therethrough of an object into the interior of the balloon when inflated, a balloon inflating housing for accommodating an inflated balloon, said housing including upper and lower hemispherical sections which may be sealingly fitted together to allow inflation of a balloon therewithin, and then separated to allow removal of the inflated balloon, an annular opening located in the upper section, through which a balloon orifice may extend, a support ring disposed in the annular opening for receiving the loading ring so that a balloon whose orifice is being held in an expanded condition extends downwardly into the housing, and one or more openings in the lower sections through which air may be evacuated from the housing to cause inflation of the balloon, pump means coupleable to the lower section of the housing and operable to pump air from the interior of the housing to thereby inflate a balloon disposed therein, and wherein said loading ring comprises a short substantially rigid hollow solid wall cylinder having a lip formed to extend radially from one end thereof, over which a balloon orifice may be placed, said lip including a plurality of gaps spaced apart about the circumference thereof.

* * * * *

UNITED STATES PATENT AND TRADEMARK OFFICE

CERTIFICATE OF CORRECTION

PATENT NO. : 5,477,664

DATED : Dec. 26, 1995

INVENTOR(S) : Carroll

It is certified that error appears in the above-identified patent and that said Letters Patent is hereby corrected as shown below:

On the title page, insert the following:

[*] Notice

The term of this patent shall not extend beyond the expiration date of Patent Number 5,337,540

Signed and Sealed this

Tenth Day of September, 1996

*Attest:*

*Attesting Officer*

BRUCE LEHMAN

*Commissioner of Patents and Trademarks*